US009425536B2

(12) United States Patent
Levante et al.

(10) Patent No.: US 9,425,536 B2
(45) Date of Patent: Aug. 23, 2016

(54) WALL OUTLET LIGHTING POWER SUPPLY SYSTEM

(71) Applicant: Inspired LED, LLC, Tempe, AZ (US)

(72) Inventors: James J. Levante, Tempe, AZ (US); Tanner J. Leland, Tempe, AZ (US)

(73) Assignee: Inspired LED, LLC, Tempe, AZ (US)

( * ) Notice: Subject to any disclaimer, the term of this patent is extended or adjusted under 35 U.S.C. 154(b) by 114 days.

(21) Appl. No.: 14/301,750

(22) Filed: Jun. 11, 2014

(65) Prior Publication Data

US 2015/0364851 A1 Dec. 17, 2015

(51) Int. Cl.

| | |
|---|---|
| ***H01R 13/46*** | (2006.01) |
| ***H01R 13/502*** | (2006.01) |
| ***F21V 23/00*** | (2015.01) |
| ***F21V 23/02*** | (2006.01) |
| ***H01R 31/06*** | (2006.01) |
| *F21V 23/06* | (2006.01) |
| *H01R 13/70* | (2006.01) |
| *H01R 13/66* | (2006.01) |
| *F21Y 103/00* | (2016.01) |
| *F21V 23/04* | (2006.01) |
| *F21Y 101/02* | (2006.01) |
| *H01R 24/28* | (2011.01) |

(52) U.S. Cl.

CPC ..... *H01R 13/502* (2013.01); *F21V 23/001* (2013.01); *F21V 23/023* (2013.01); *H01R 31/065* (2013.01); *F21S 4/24* (2016.01); *F21V 23/0435* (2013.01); *F21Y 2101/02* (2013.01); *F21Y 2103/003* (2013.01); *H01R 13/6675* (2013.01); *H01R 13/70* (2013.01); *H01R 24/28* (2013.01)

(58) Field of Classification Search

CPC ..... F21V 23/007–23/009; F21V 23/001; F21V 23/023; F21S 8/03–8/036; H01R 13/502; H01R 31/065

See application file for complete search history.

(56) References Cited

U.S. PATENT DOCUMENTS

| | | | | |
|---|---|---|---|---|
| 6,478,440 | B1 * | 11/2002 | Jaworski | A01M 1/04 362/253 |
| 2012/0057370 | A1 * | 3/2012 | Chien | F21S 9/02 362/640 |
| 2013/0058073 | A1 * | 3/2013 | Walker | F21S 8/035 362/95 |

OTHER PUBLICATIONS www.hammacher.com/Product/82627?cm_cat=ProductSEM &cm_pla=AdWordsPLA&source=PRODSEM &gclid=CLu09s3RjbsCFUtp7AodV2EADQ Plug-in USB Wall Outlets; Hammacher Schlemmer; Rcvd Nov. 30, 2013.

http://inspiredled.com/products/lights%20and%20accessories/lutron-wall-dimmer; Lutron Wall Dimmer from Inspired LED LLC; Received and Printed on Apr. 15, 2014.

* cited by examiner

*Primary Examiner* — Anh Mai
*Assistant Examiner* — Nathaniel Lee
(74) *Attorney, Agent, or Firm* — Neustel Law Offices; Michael S. Neustel

(57) ABSTRACT

A wall outlet lighting power supply system for efficiently providing electrical power to low voltage lighting utilizing a conventional AC wall outlet. The wall outlet lighting power supply system generally includes a housing, a power plug attached to the housing for electrically connecting to a power socket of a conventional wall outlet, a low voltage power supply positioned within the housing and electrically connected to the power plug, and a plurality of low voltage wires extending from housing and electrically connected to the low voltage power supply. The housing includes at least one spacer to maintain a rear wall of the housing in a parallel relationship with respect to a building wall when connected to the wall outlet. The housing includes a door to provide access to a wiring area. The housing also includes at least one opening to allow for the low voltage wires to extend through.

17 Claims, 14 Drawing Sheets

WALL OUTLET LIGHTING POWER SUPPLY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a power supply for low voltage lighting and more specifically it relates to a wall outlet lighting power supply system for efficiently providing electrical power to low voltage lighting utilizing a conventional AC wall outlet.

2. Description of the Related Art

Any discussion of the related art throughout the specification should in no way be considered as an admission that such related art is widely known or forms part of common general knowledge in the field.

Low voltage power supplies are used to convert high voltage alternating current (AC) electrical power to low voltage direct current (DC) electrical power such as but not limited to 12 volts DC. Low voltage power supplies are used to provide electrical power to various items such as outdoor lighting, indoor lighting, light strips and flexible LED light strips. Light strips, such as flexible LED light strips, have become increasingly popular in various applications such as but not limited to under cabinet lighting, TV back lighting, staircase lighting, architectural lighting, bar lighting, kitchen lighting, toe kick lighting, ceiling cove lighting, decorations and vehicles. A flexible LED light strip is comprised of an elongated flexible strip of printed circuit board (PCB) having two or more electrically conductive traces to provide electrical power, a plurality of light-emitting diodes (LED) attached along the front surface of the flexible strip and electrically connected to the conductive traces, and a length of adhesive along the back surface of the flexible strip. The LEDs may emit the same light or may change colors to provide a range of light options. Most conventional flexible LED light strips utilize a low-voltage 12V DC electrical power.

Conventional light strips, including flexible LED light strips, require a low voltage power supply to be installed by an electrician. The electrician electrically connects the low voltage power supply to a light switch or an electrical junction box that is positioned within the building wall. The installer must first directly wire the low voltage power supply to the light switch or electrical junction box with the wires extending either through the wall or outside of the wall with a spacer or conduit. The installer then attaches the low voltage power supply to the outside surface of the wall near the light switch or electrical junction box utilizing conventional fasteners.

The main problem with conventional power supplies is that they are awkward to install since they must be attached to a wall and then have wires ran through the wall to the light switch or electrical junction box. Another problem with conventional power supplies is that they are difficult for the end consumer to install and often times require an electrician to install thereby delaying and increasing the cost of the installation. Another problem with conventional power supplies is that they are bulky and unsightly making them difficult to install in a professional looking manner.

Another type of low voltage power supply is comprised of a wall outlet plugin that plugs directly into the wall with the AC/DC converter outside of the wall outlet and the low voltage wires extending from the converter. The main problem with wall outlet power supplies is that they are unsightly and require the low voltage wires to be exposed. Another problem is the wall outlet power supplies require an AC power wall outlet near the light switch.

Because of the inherent problems with the related art, there is a need for a new and improved wall outlet lighting power supply system for efficiently providing electrical power to low voltage lighting utilizing a conventional AC wall outlet.

BRIEF SUMMARY OF THE INVENTION

The invention generally relates to a power supply for low voltage lighting which includes a housing, a power plug attached to the housing for electrically connecting to a power socket of a conventional wall outlet, a low voltage power supply positioned within the housing and electrically connected to the power plug, and a plurality of low voltage wires extending from housing and electrically connected to the low voltage power supply. The housing includes at least one spacer to maintain a rear wall of the housing in a parallel relationship with respect to a building wall when connected to the wall outlet. The housing includes a door to provide access to a wiring area. The housing also includes at least one opening to allow for the low voltage wires to extend through.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
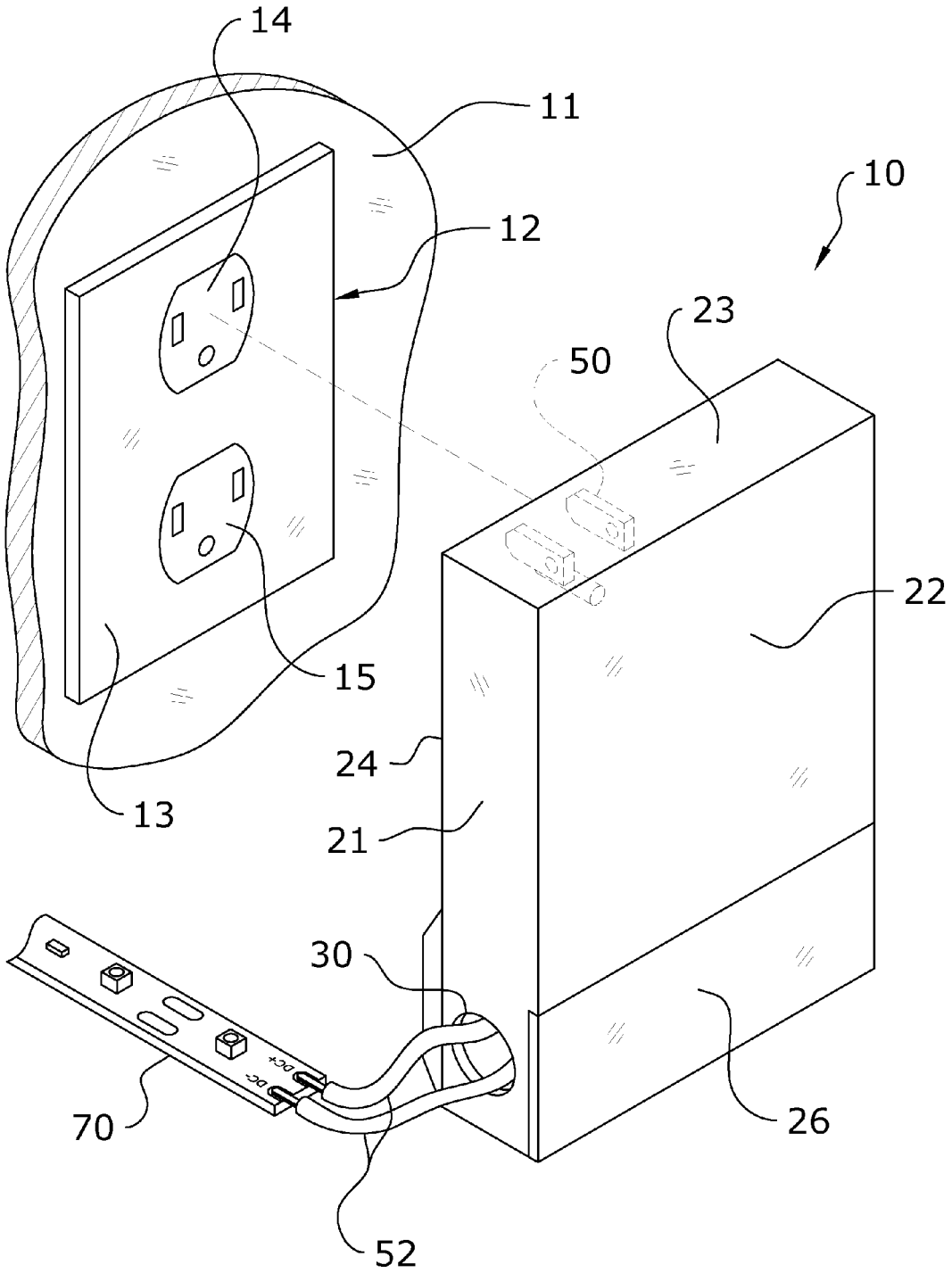
FIG. 1 is a front upper perspective view of the present invention.

A. Overview.

Turning now descriptively to the drawings, in which similar reference characters denote similar elements throughout the several views, FIGS. 1 through 14 illustrate a wall outlet lighting power supply system 10, which comprises a housing 20, a power plug 50 attached to the housing 20 for electrically connecting to a power socket of a conventional wall outlet 12, a low voltage power supply 62 positioned within the housing 20 and electrically connected to the power plug 50, and a plurality of low voltage wires 52 extending from housing 20 and electrically connected to the low voltage power supply 62. The housing 20 includes at least one spacer to maintain a rear wall 24 of the housing 20 in a parallel relationship with respect to a building wall 11 when connected to the wall outlet 12. The housing 20 includes a door 26 to provide access to a wiring area 27. The housing 20 also includes at least one opening to allow for the low voltage wires 52 to extend through.

Figure 8:
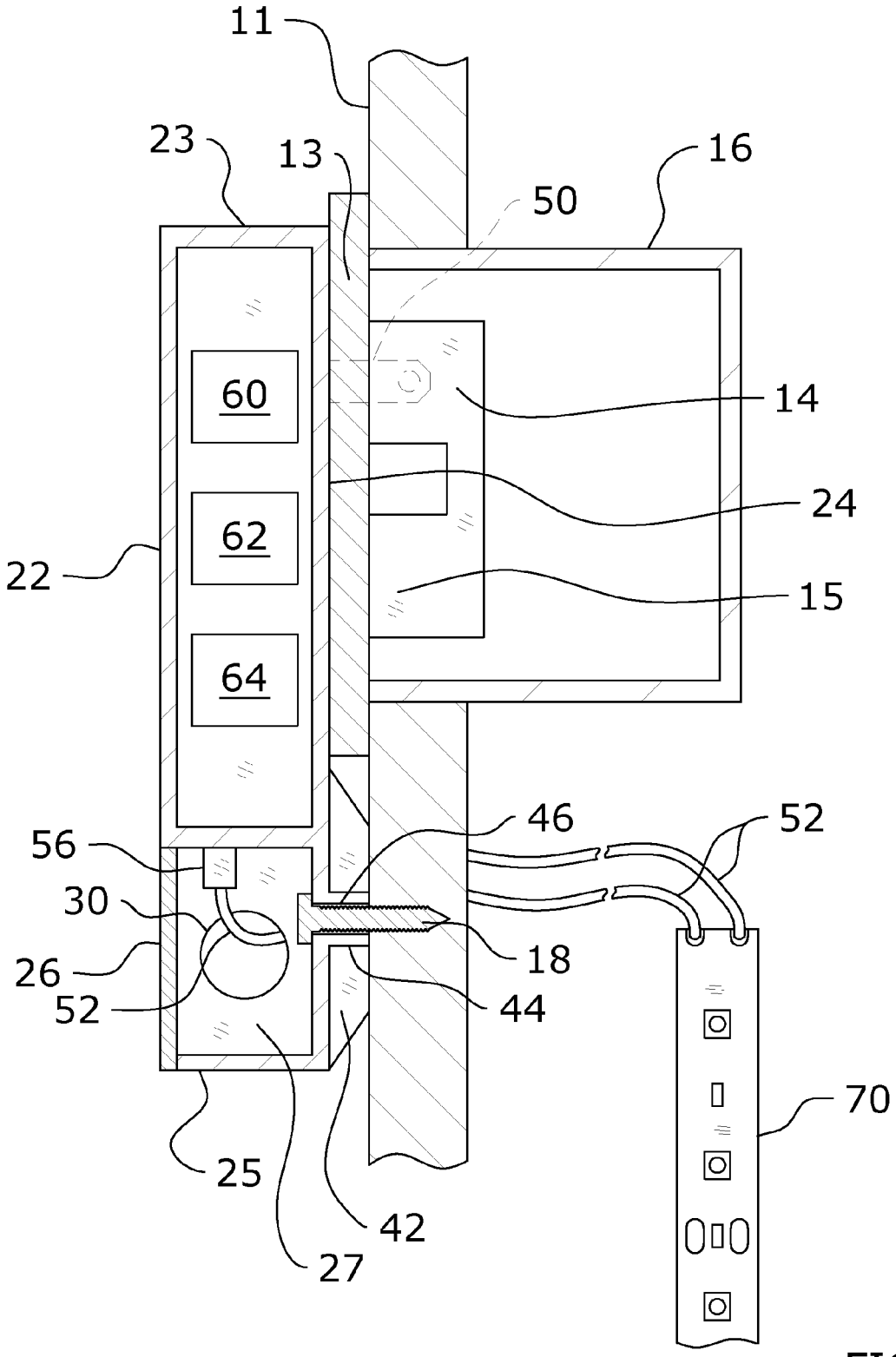
FIG. 8 is a side cutaway view of the present invention attached to a conventional wall outlet.

FIGS. 1 and 8 illustrate a conventional wall outlet 12 having an upper power socket 14, a lower power socket 15 and a wall plate 13 that surrounds the wall outlet 12. The wall outlet 12 further includes a conventional junction box 16 that is attached to a wall stud or the building wall 11. The wall outlet 12 may have different structures and designs which are well known in the electrical industry to provide alternating current (AC) electrical power.

B. Housing.

FIGS. 1 through 13 illustrate exemplary housings 20 suitable for usage for the present invention. The housing 20 is preferably constructed of a non-conductive material such as but not limited to plastic. The housing 20 is further preferably comprised of a rectangular shaped structure as best illustrated in FIGS. 1 through 6 of the drawings, however, the housing 20 may have various other shapes. The housing 20 preferably is comprised of a front wall 22, a rear wall 24, a pair of side walls connecting the front wall 22 to the rear wall 24, an upper portion 23 and a lower portion 25.

Figure 11:
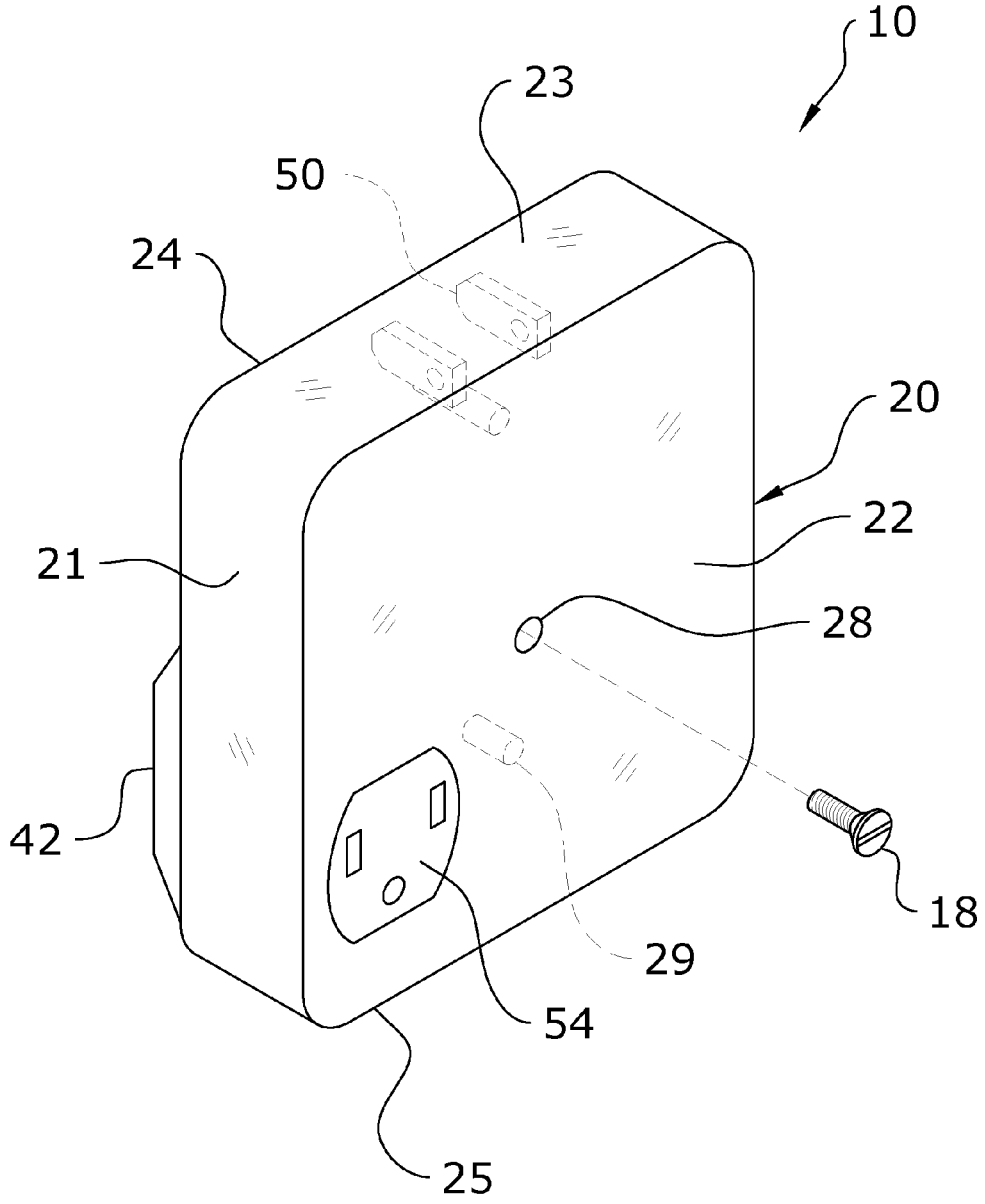
FIG. 11 is an upper perspective view of an alternative embodiment of the present invention.
Figure 12:
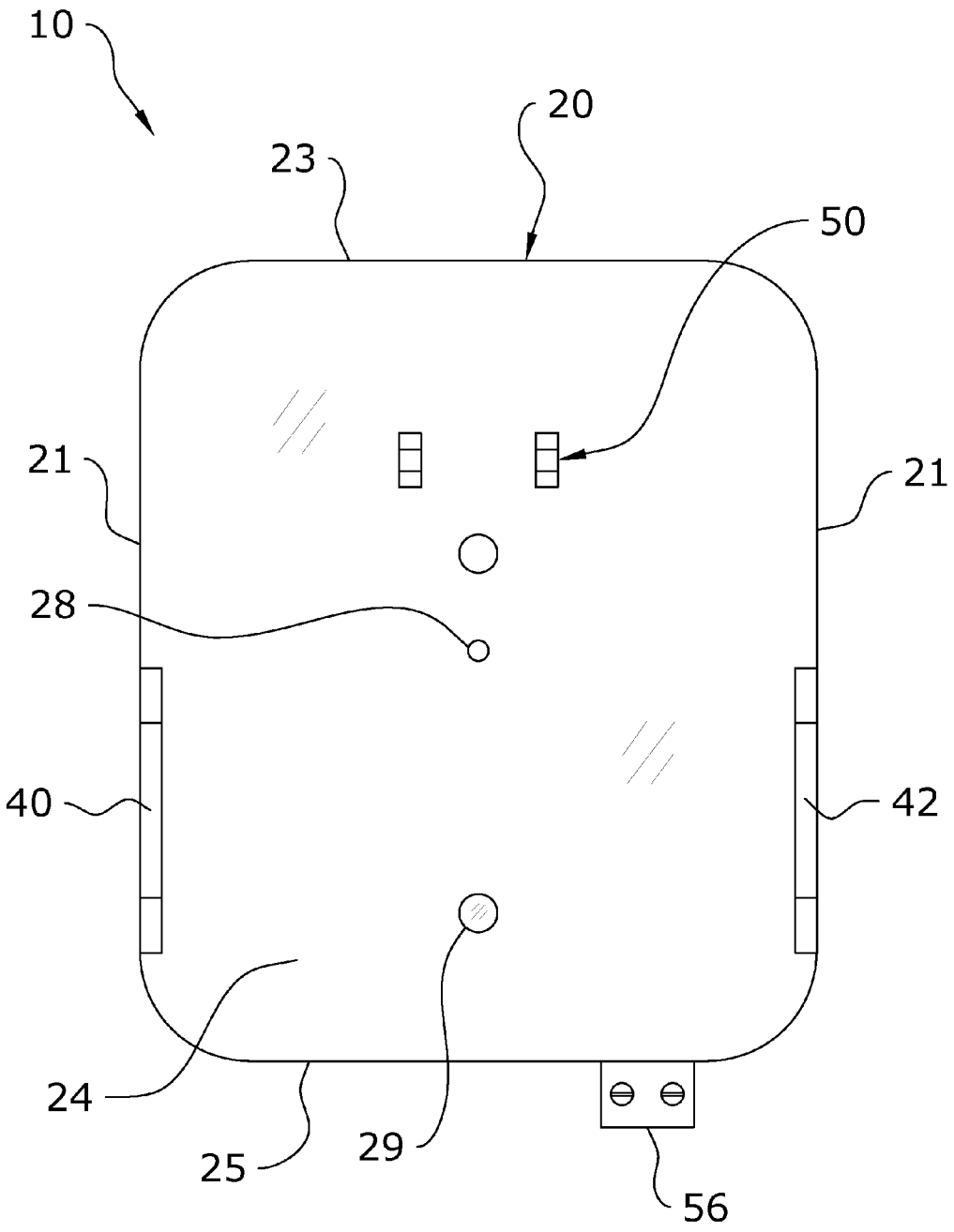
FIG. 12 is a rear view of the alternative embodiment of FIG. 11.

The housing 20 preferably includes a fastener opening 28 that receives a fastener member 18 to directly attach the housing 20 to the wall outlet 12 by using the opening within the wall plate 13 as illustrated in FIGS. 11 and 12 of the drawings. The housing 20 also may include a guide member 29 comprised of a non-conductive material that extends outwardly and is insertable into the ground plug of the lower power socket 15 when the power plug 50 is inserted into the upper power socket 14 as illustrated in FIG. 12 of the drawings.

The housing 20 has an interior space that stores and protects the electronic components utilized to provide low voltage power to low voltage lighting 70 such a flexible LED light strips (e.g. a power switch 60, a low voltage power supply 62, a dimmer switch 64 and the like). The housing 20 preferably has a main interior that stores the electronic components and a wiring area 27 that is separated from the main interior. The housing 20 may include an auxiliary power socket 54 that is positioned within the front wall 22 of the housing 20 and electrically connected to the power plug 50 to provide AC power to an external device as illustrated in FIG. 11 of the drawings.

C. Wiring Area.

Figure 4:
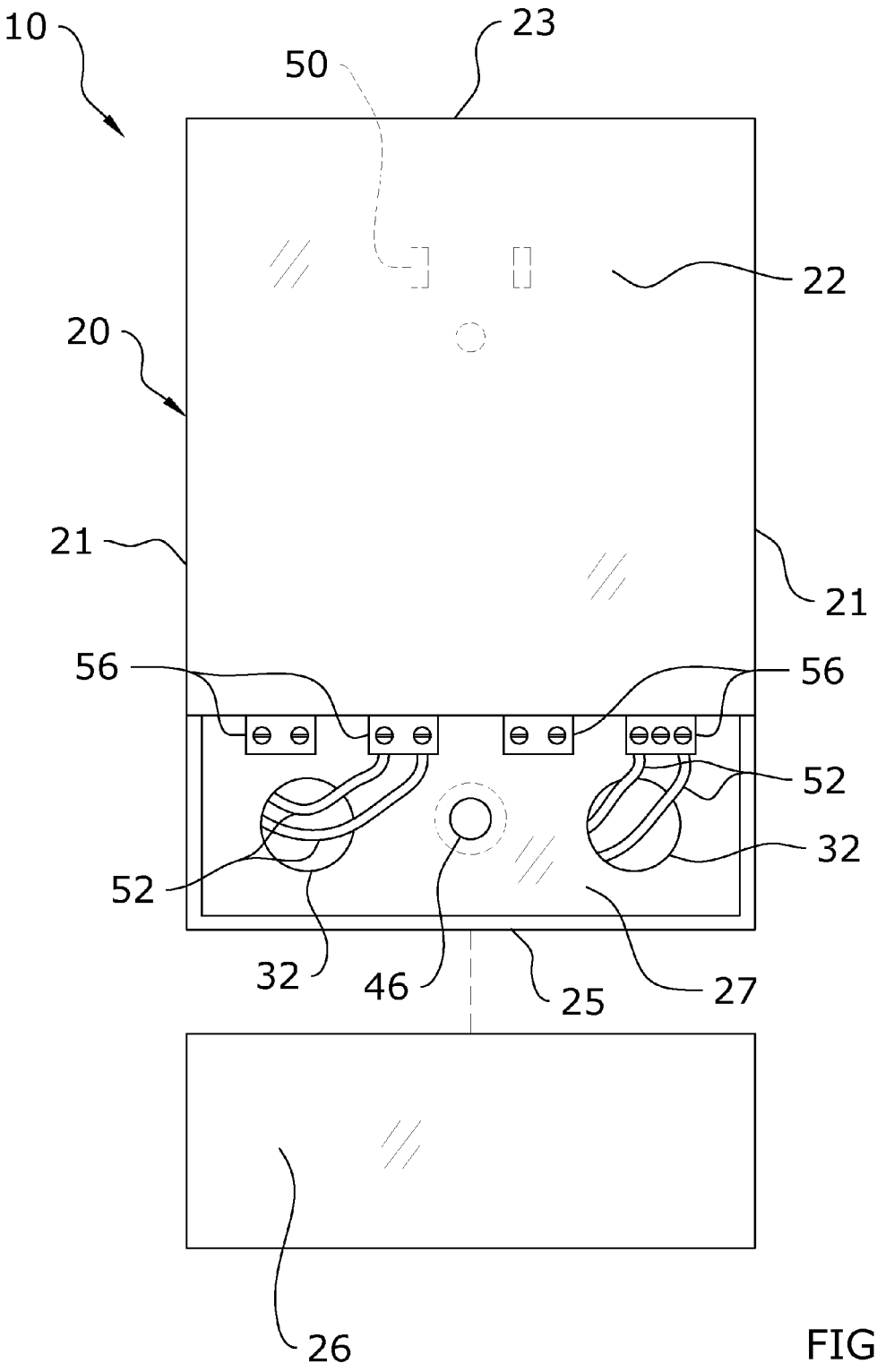
FIG. 4 is a front view of the present invention with the door removed.
Figure 10:
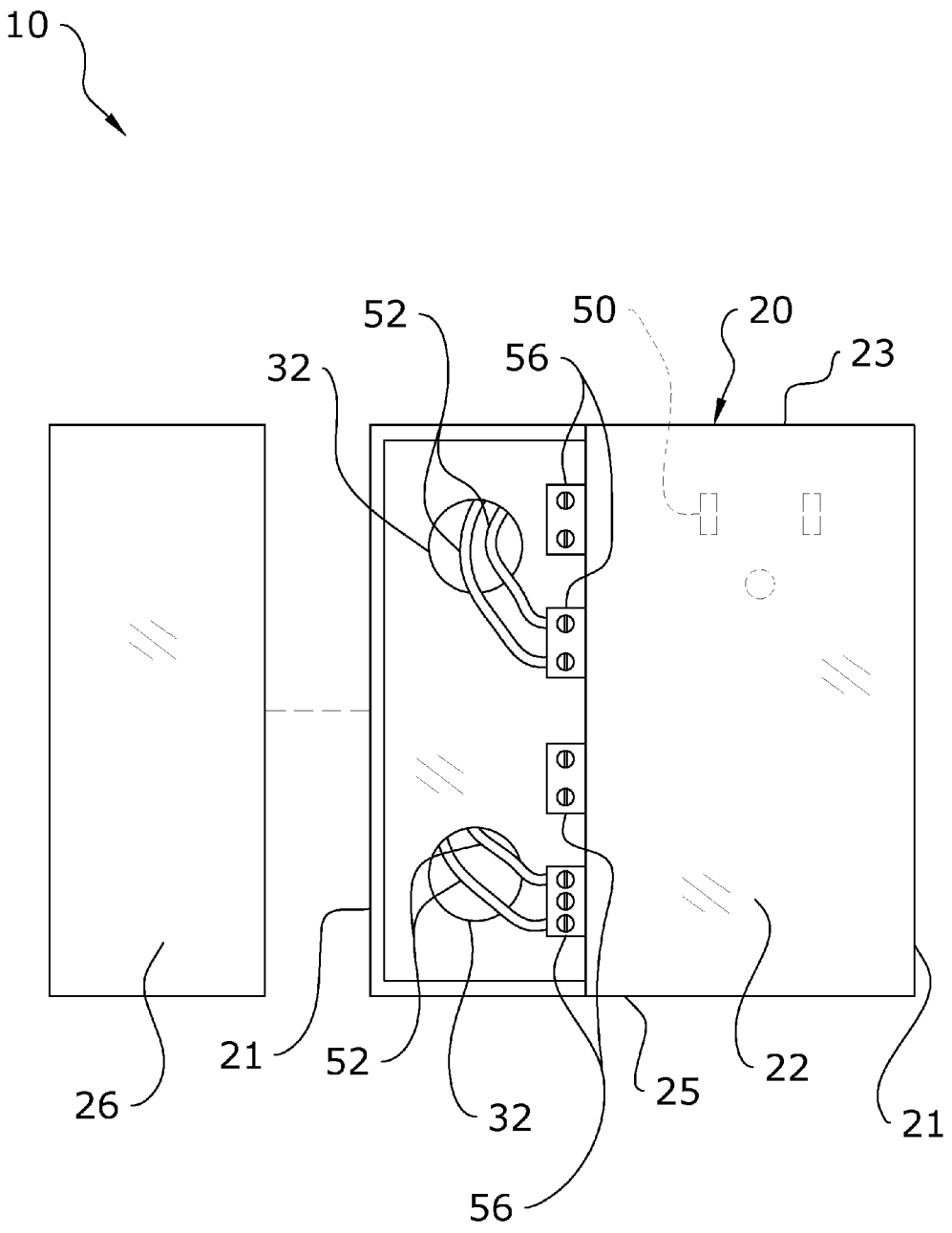
FIG. 10 is an exploded view of a variation of the present invention with the door and the wiring area on a side of the housing.

The wiring area 27 is a space utilized for connecting electrical wires such as the low voltage wires 52 extending from the main interior. The low voltage wires 52 extend from the low voltage power supply 62 within the main interior area into the wiring area 27. The wiring area 27 is further for providing access to the openings 30, 32 within the housing 20 to extend the low voltage wires 52 through to the low voltage lighting 70 or other low voltage electrical device to be electrically connected to the low voltage power supply 62. The wiring area 27 is preferably within a lower part of the housing 20 as illustrated in FIGS. 4 and 8 of the drawings, however, the wiring area 27 may be positioned within the upper part or a side part of the housing 20 as illustrated in FIG. 10 of the drawings.

The wiring area 27 is preferably separated from the main interior by a divider as best illustrated in FIG. 8 of the drawings. At least one door 26 is removably attached to the housing 20 to selectively enclose and expose the wiring area 27 as shown in FIGS. 4, 8 and 10 of the drawings. The door 26 is preferably slidably connected to the housing 20 exposing an opening within the front wall 22 or one of the sidewalls 21 of the housing 20 thereby exposing the wiring area 27 and the low voltage wires 52.

Figure 13:
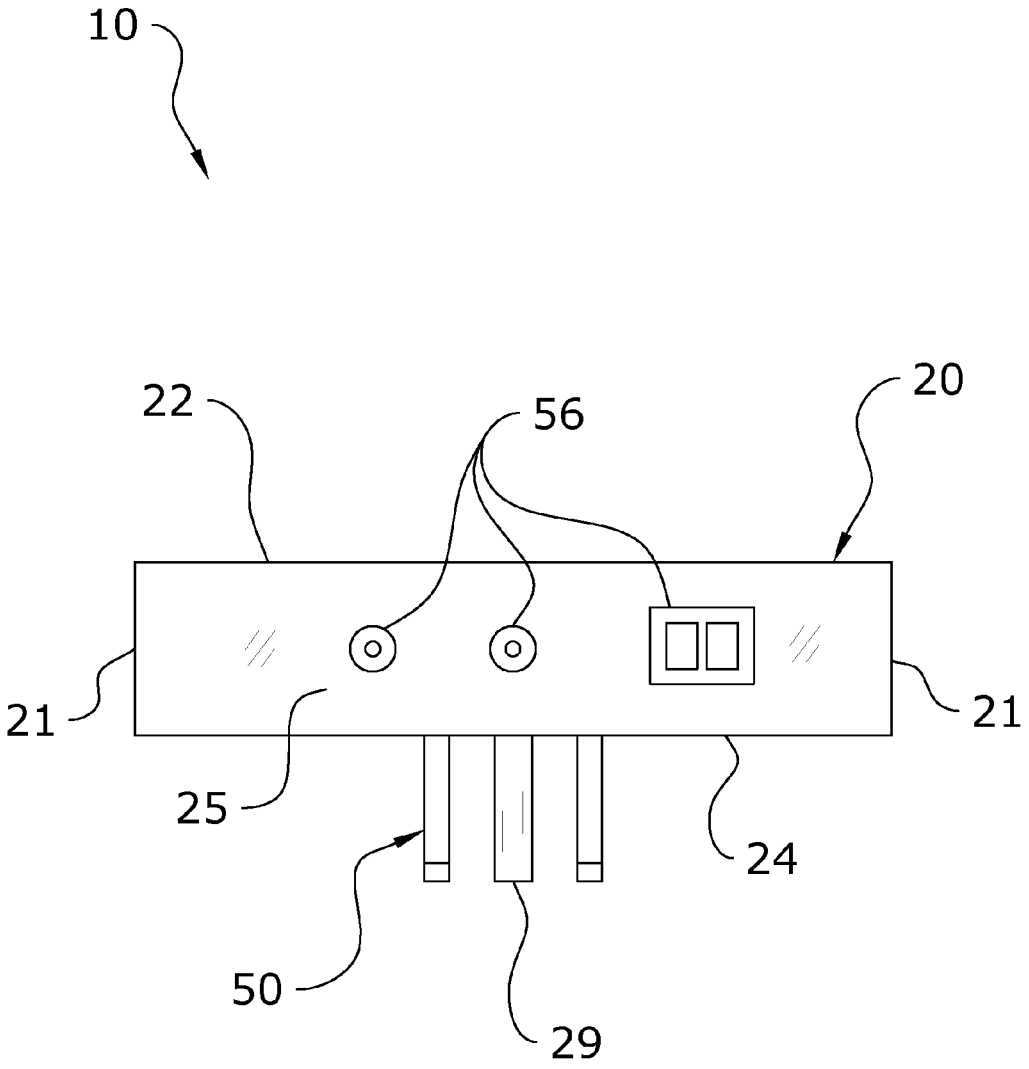
FIG. 13 is a bottom view of the alternative embodiment of FIG. 11.

Low voltage connectors 56 may be utilized that are attached to the housing 20 and that are electrically connected to the low voltage power supply 62 thereby allowing low voltage wires 52 to be easily connected and removed. FIGS. 4, 8 and 10 illustrate a low voltage connector that utilizes fasteners to removably attach exposed low voltage wires 52 and FIG. 13 illustrates a low voltage connector that has an electrical coupler structure that low voltage wires 52 with mating couplers can be removably connected to. The low voltage connectors 56 are preferably positioned within the wiring area 27 as illustrated in FIGS. 4, 8 and 10 of the drawings, however, the low voltage connectors 56 may be positioned externally of the housing 20 as illustrated in FIG. 13 of the drawings.

D. Wire Openings.

The housing 20 includes at least one side opening to allow the low voltage wires 52 to extend through and outside of the housing 20 to be electrically connected to the low voltage lighting 70 or other low voltage device. The housing 20 preferably includes at least one side opening within one or both of the sidewalls 21 connecting the wiring area 27 and an area external of the housing 20 as illustrated in FIGS. 1, 2, 6 and 8 of the drawings.

The housing 20 further preferably includes at least one rear opening within the rear wall 24 of the housing 20 connecting the wiring area 27 and an area external of the housing 20. It is preferable to have a plurality of rear openings 32 and a plurality of side openings 30 as illustrated in FIGS. 2 through 6 the drawings. The side openings 30 and the rear openings 32 may have removable covers to allow the installer to easily remove selected openings 30, 32 that they want to extend low voltage wires 52 through.

E. Spacers.

Figure 2:
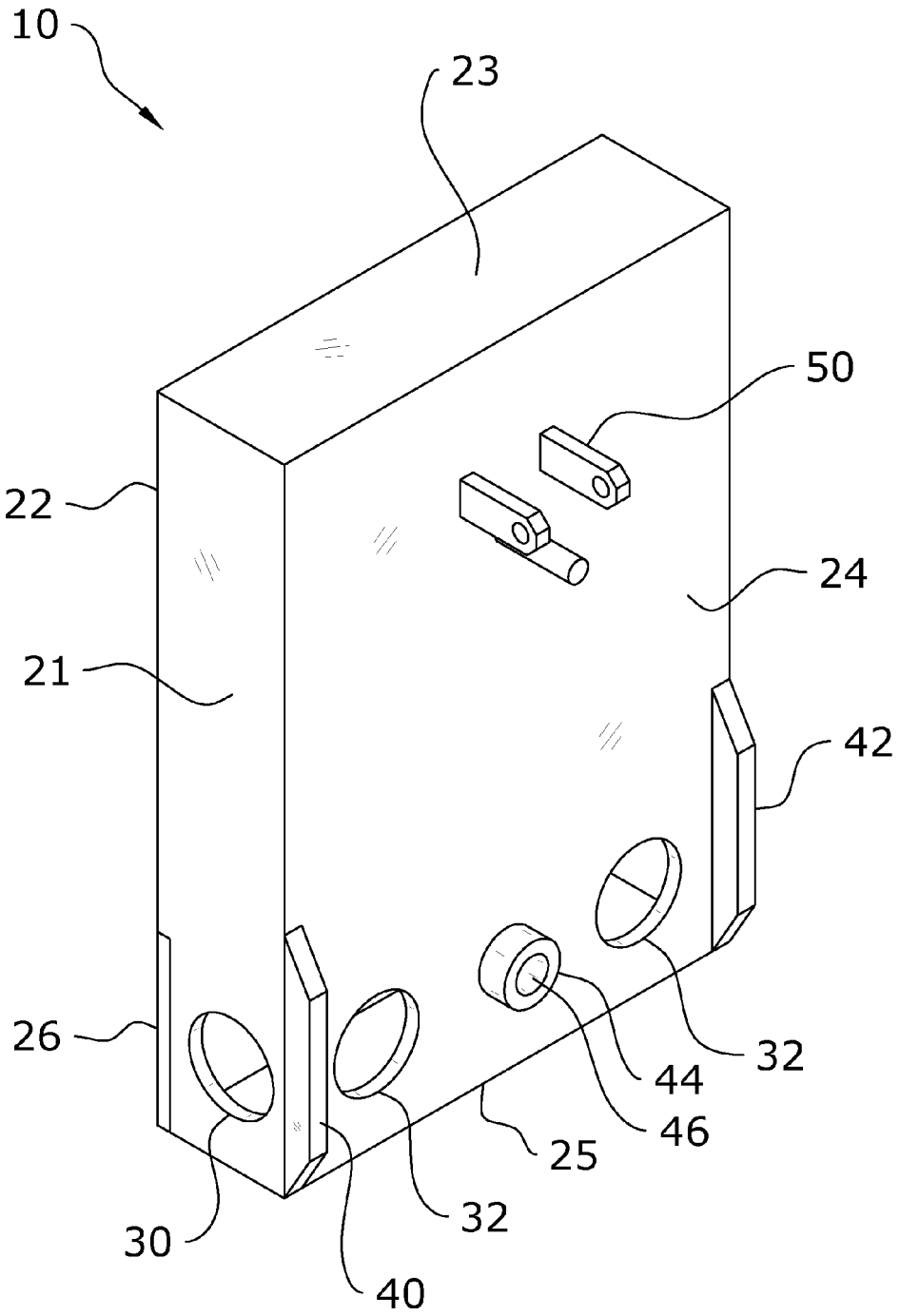
FIG. 2 is a rear upper perspective view of the present invention.
Figure 3:
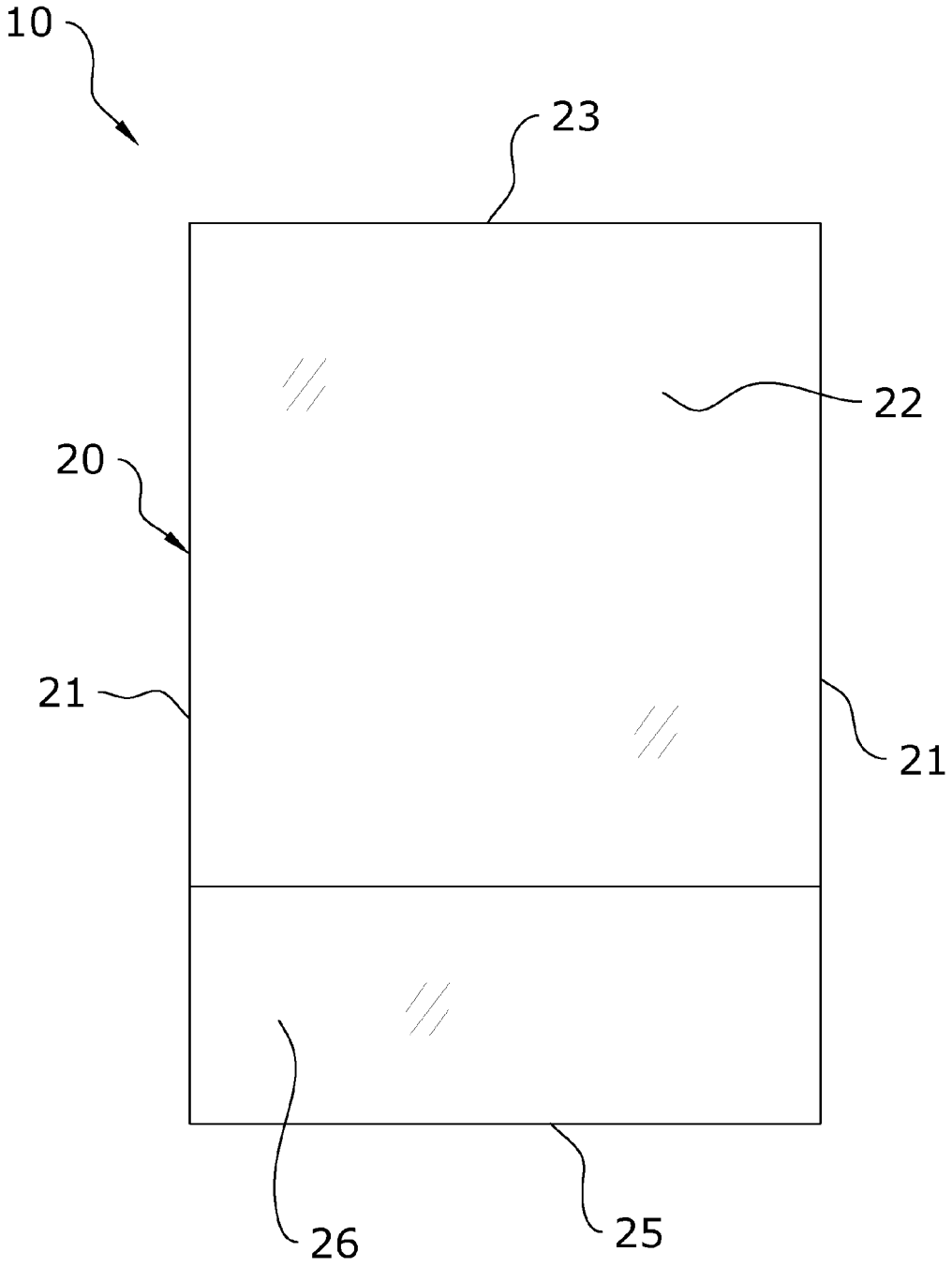
FIG. 3 is a front view of the present invention.
Figure 5:
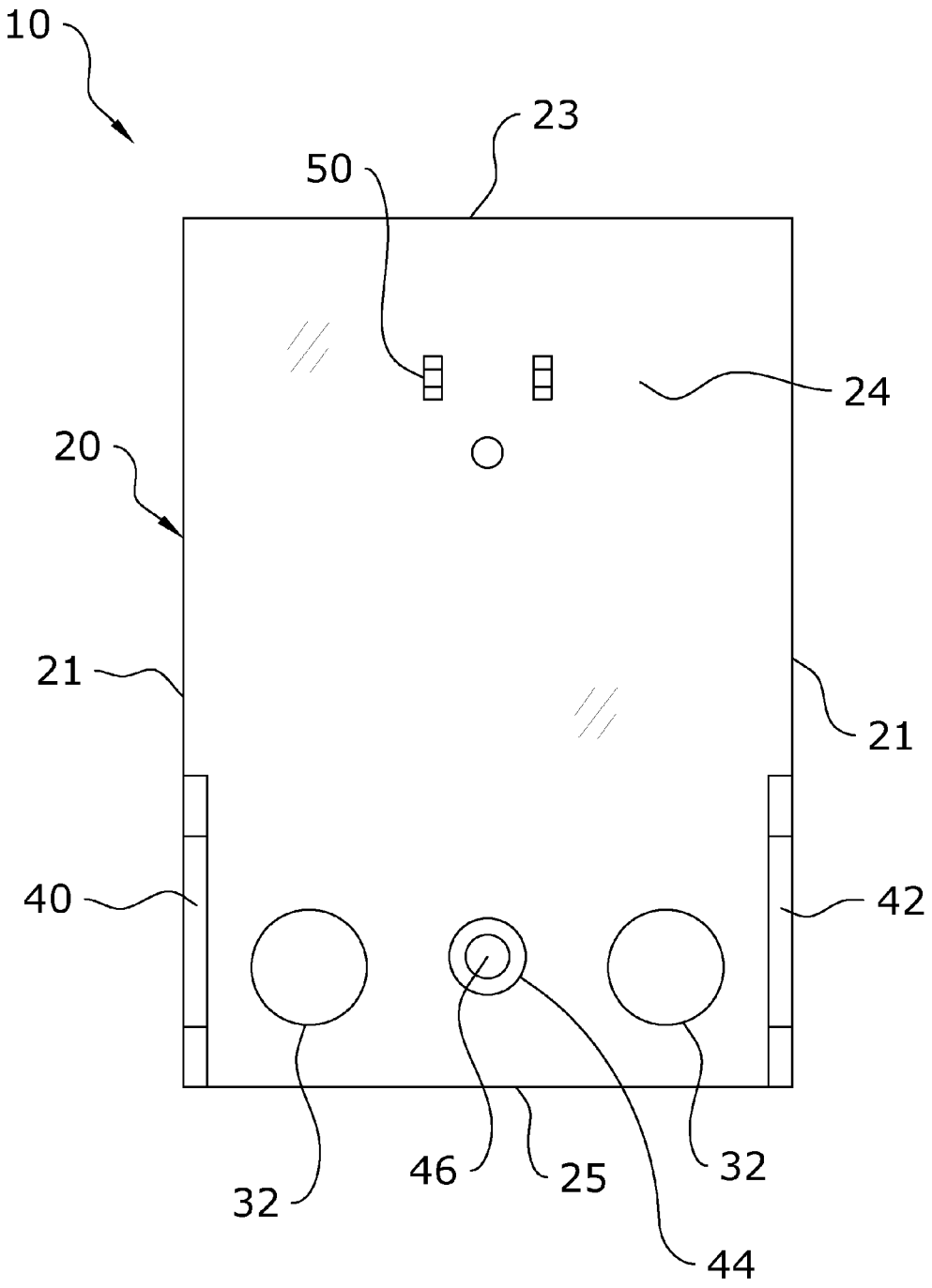
FIG. 5 is a rear view of the present invention.
Figure 9:
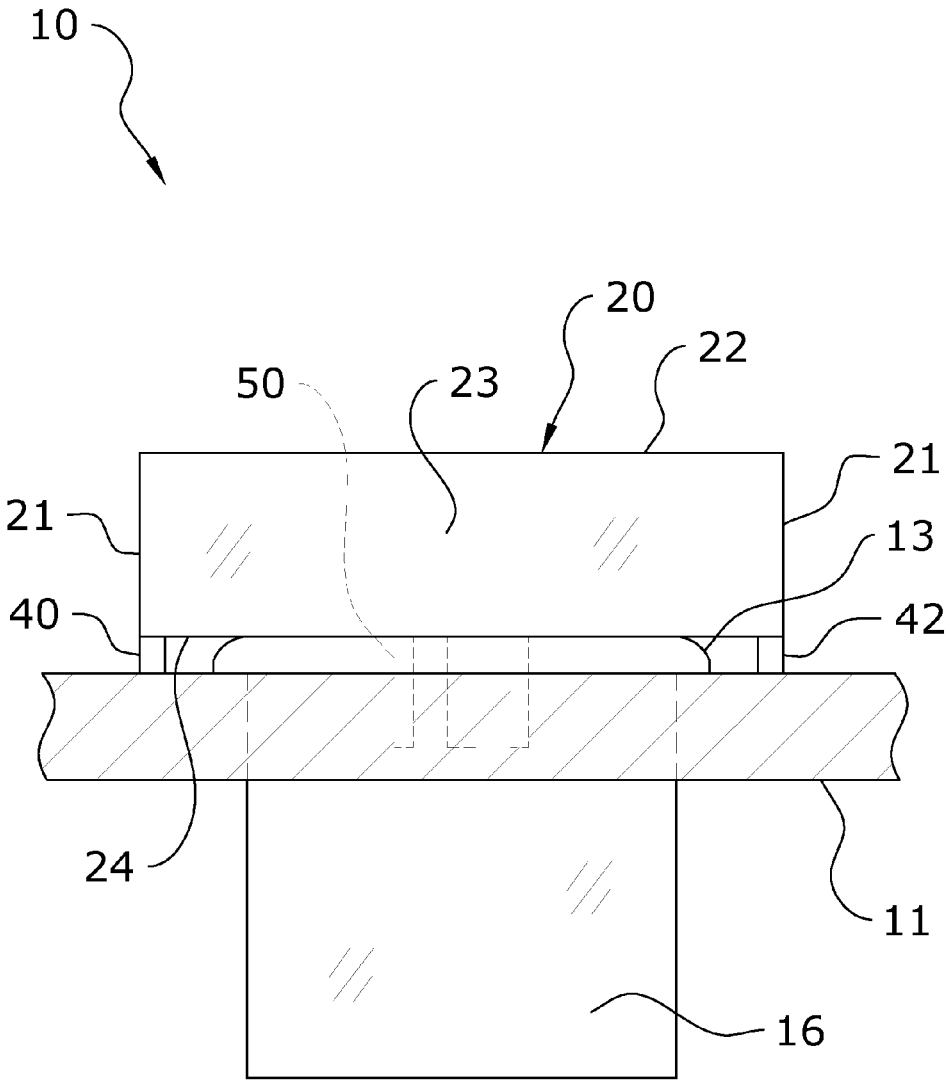
FIG. 9 is a top view of the present invention attached to the conventional wall outlet.

The housing 20 includes at least one spacer 40, 42 extending outwardly from the rear wall 24 of the housing 20 as best illustrated in FIGS. 2 and 5 of the drawings. The spacer 40, 42 is positioned so that a distal end of the spacer 40, 42 engages a building wall 11 surrounding a wall outlet 12 and not a wall plate 13 that encloses the wall outlet 12 when the power plug 50 is connected to the power socket of the wall outlet 12 as illustrated in FIGS. 8 and 9 of the drawings.

The spacer 40, 42 is near the lower portion 25 of the housing 20. The spacer 40, 42 extends outward from the rear wall 24 a distance at least equal to or greater than a thickness of a wall plate 13 for the wall outlet 12 (e.g. greater than ¼ of an inch). In particular, the at least one spacer extends outwardly a distance from the rear wall 24 sufficient to maintain a parallel relationship between a rear surface of the rear wall 24 and a building wall 11 surrounding the wall outlet 12 when the power plug 50 is fully inserted into the power socket as best illustrated in FIG. 8 of the drawings.

The housing 20 preferably has a width greater than the width of the wall plate 13 and more particularly a width greater than 2¾ inches. The spacers 40, 42 are positioned near each of the opposing sidewalls 21 to prevent engagement with the wall plate 13 by the spacers 40, 42 when the power plug 50 is inserted into the upper power socket 14 or the lower power socket 15 as best illustrated in FIGS. 2 and 9 of the drawings.

The housing 20 preferably includes a first spacer 40 extending outwardly from the rear wall 24 of the housing 20 near a first sidewall 21 of the housing 20 and a second spacer 42 extending outwardly from the rear wall 24 of the housing 20 near a second sidewall 21 of the housing 20 (wherein the second sidewall 21 is opposite of the first sidewall 21 of the housing 20) as illustrated in FIGS. 2, 5, 7 and 9 of the drawings.

Figure 6:
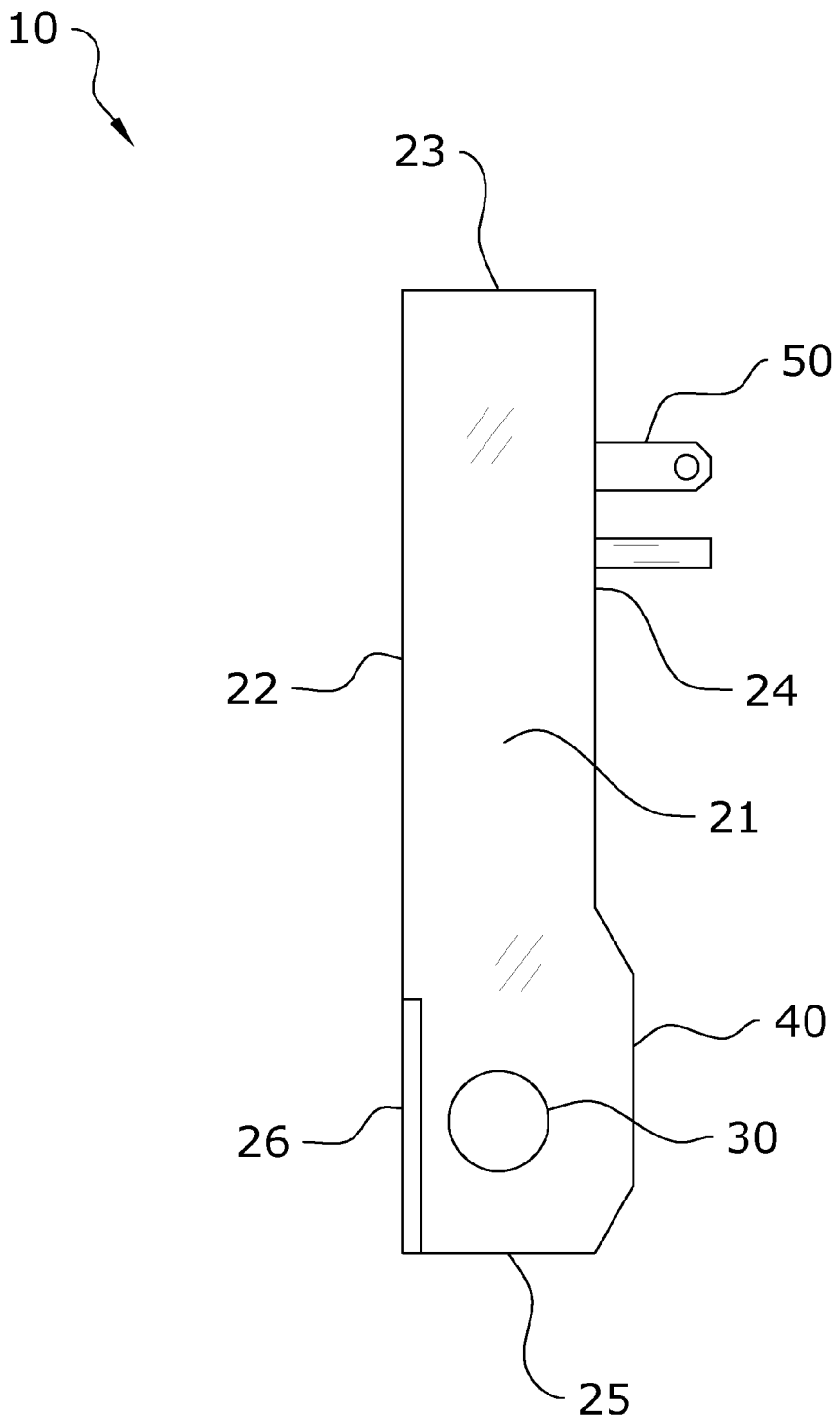
FIG. 6 is a side view of the present invention.
Figure 7:
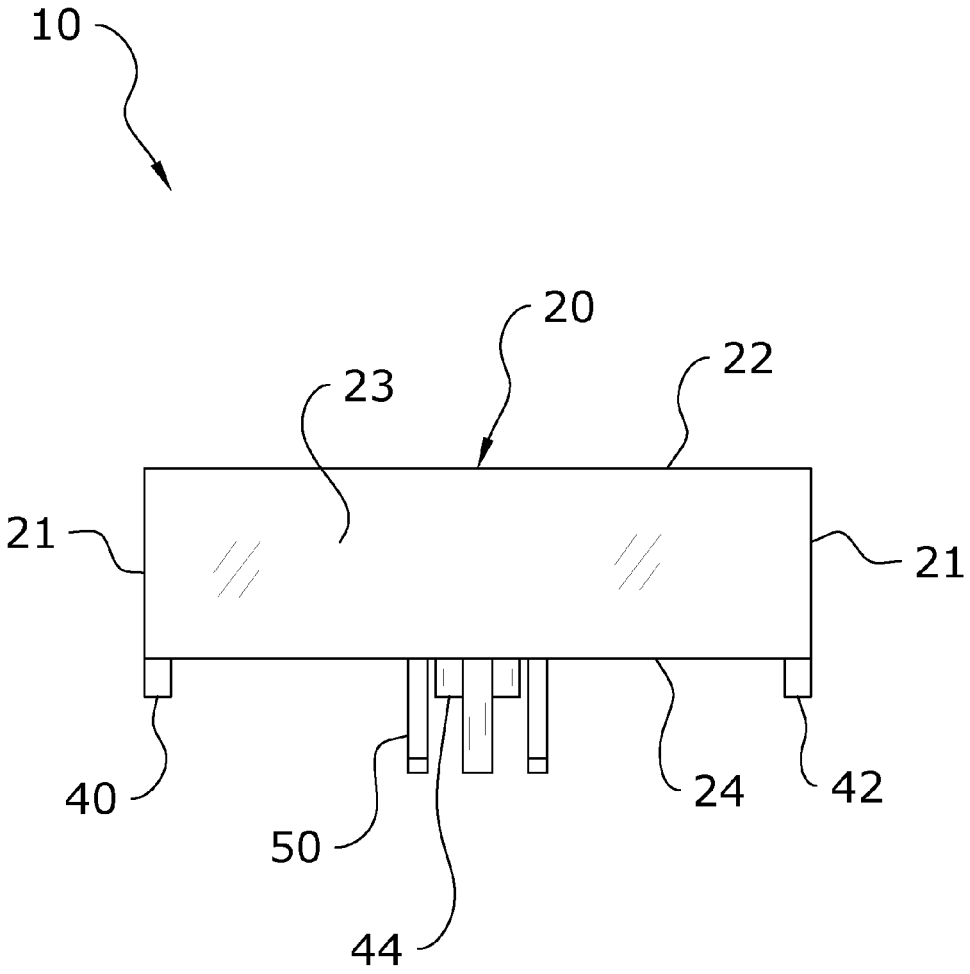
FIG. 7 is a top view of the present invention.

Each of the spacers 40, 42 preferably has a vertical rear edge opposite of the rear wall 24 along with an upper angled portion and a lower angled portion as illustrated in FIGS. 2 and 6 of the drawings. The vertical rear edge is parallel to the surface of the building wall 11 and touches the building wall 11 when the power plug 50 is inserted into the power socket 14, 16. The spacers 40, 42 are preferably integrally formed within the housing 20. The spacers 40, 42 are further preferably parallel with respect to one another and mirror one another.

F. Wall Securing System.

An aperture 46 preferably extends through a rear wall 24 of the housing 20 from within the wiring area 27. The aperture 46 receives a fastener member 18 (e.g. threaded fastener, screw) to secure the housing 20 to a building wall 11 to prevent movement or removal of the present invention from the wall outlet 12 as illustrated in FIG. 8. A fastener spacer 44 preferably surrounds the aperture 46 and extends outwardly from the rear wall 24 to distally space the rear wall 24 from the building wall 11 when the fastener member 18 attaches the housing 20 to the building wall 11 as best illustrated in FIG. 2 of the drawings.

The fastener spacer 44 is comprised of a ring structure having a center opening that is aligned with the aperture 46. The fastener spacer 44 ensures that the housing 20 is not pulled inwardly in a non-parallel manner with respect to the surface of the building wall 11 when the fastener member 18 is inserted and attached to the building wall 11. The fastener spacer 44 extends outwardly from the rear wall 24 a distance equal to or substantially the same as the spacers 40, 42.

G. Power Plug.

The power plug 50 is attached to the housing 20 and is adapted for electrically connecting to a power socket 14, 15 of a wall outlet 12. The power plug 50 may be a two-prong or a three-prong design as illustrated in FIG. 2 of the drawings. The power plug 50 is preferably located within an upper part of the rear wall 24 as illustrated in FIG. 2 of the drawings. While a single power plug 50 is illustrated, a second power plug 50 may be utilized to be connected to one or more low voltage power supply 62 within the housing 20 wherein the first power plug 50 is connected to the upper power socket 14 and the second power plug 50 is connected to the lower power socket 15 to provide increased electrical power to the present invention for low voltage systems that have higher power requirements.

H. Low Voltage Power Supply.

The low voltage power supply 62 is positioned within the main interior of the housing 20 and is electrically connected to the power plug 50 directly or indirectly (e.g. a power switch 60 may be positioned between the low voltage power supply 62 and the power plug 50). The low voltage power supply 62 provides a low voltage direct current power source for the low voltage lighting 70. The low voltage power supply 62 preferably is completely enclosed by the housing 20 as illustrated in FIG. 8 of the drawings. The low voltage power supply 62 is preferably comprised of an alternating current (AC) to direct current (DC) converter (a.k.a. AC/DC converter, AC/DC power supply) wherein high voltage AC electrical power (e.g. 120V AC) is converted to low voltage DC electrical power (e.g. 12V DC). The low voltage power supply 62 preferably converts the high voltage AC electrical power to a low voltage DC electrical power ranging from 5V DC to 48V DC (e.g. 12V DC, 24V DC). The low voltage power supply 62 preferably converts 120V AC electrical power to 12V DC electrical power.

I. Power Switch.

A power switch 60 is preferably within the main interior of the housing 20 that is electrically connected to the low voltage power supply 62 to control AC electrical power to the low voltage power supply 62 from the power plug 50. The power switch 60 is remotely activated by a remote control sending a wireless signal to the power switch 60 which has a corresponding receiver. The power switch 60 may be comprised of a manual switch (e.g. toggle switch) connected to the housing 20 and accessible externally of the housing 20.

J. Dimmer Switch.

Figure 14:
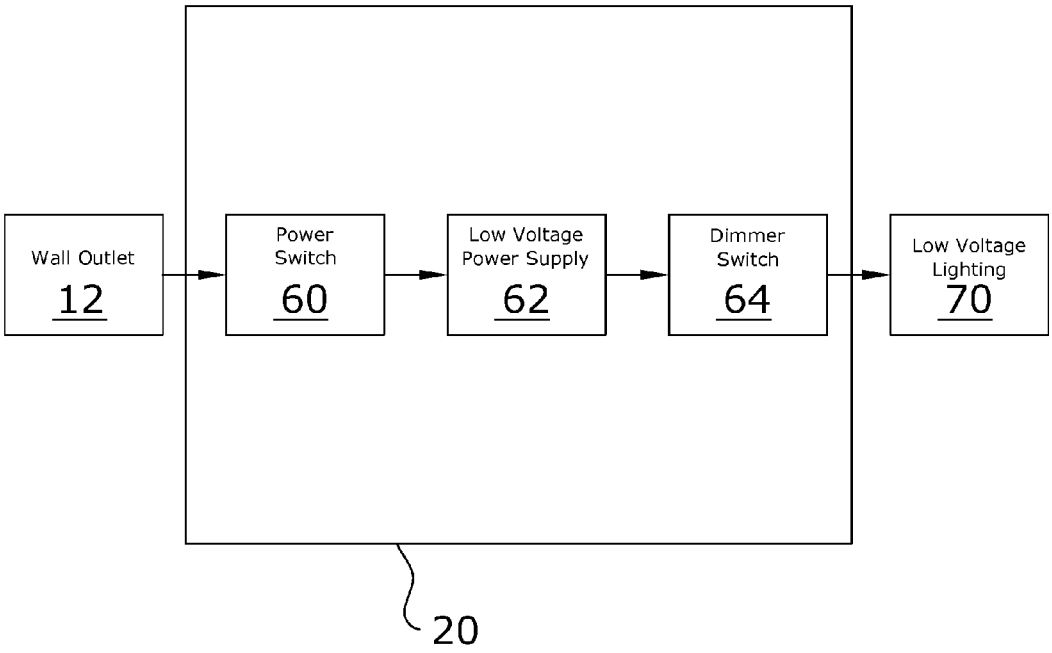
FIG. 14 is a block diagram illustrating the electrical connections of the present invention.

A dimmer switch 64 is also preferably positioned within the main interior of the housing 20. The dimmer switch 64 is electrically connected to the low voltage power supply 62 and/or the power switch 60. However, it is preferable to have the dimmer switch 64 electrically connected on the low voltage side of the low voltage power supply 62 as illustrated in FIG. 14. The dimmer switch 64 controls a voltage level of the low voltage direct current from the low voltage power supply 62 thereby allowing for selective dimming of the low voltage lighting 70 by the user. The dimmer switch 64 is preferably activated and controlled by a remote control similar to the power switch 60 discussed previously, however, the dimmer switch 64 may be comprised of a manual switch that allows for adjustment of the voltage level (e.g. a sliding switch).

K. Low Voltage Lighting.

The present invention is preferably utilized in combination with one or more low voltage lighting 70. The low voltage lighting 70 is preferably comprised of a light strip and is further preferably comprised of a flexible light emitting diode (LED) light strip as illustrated in FIGS. 1 and 8 of the drawings. The flexible LED light strip includes a plurality of light emitting diodes (LEDs) that are spaced apart and are electrically powered by DC voltage that may range from 5V DC to 48V DC (e.g. 12V DC, 24V DC). The flexible LED light strip may have various lengths (e.g. 9 feet, 30 feet, 45 feet, 50 feet, 55 feet or longer) and widths. One or both of the ends of the flexible LED light strip may include electrical connectors for electrically connecting to the low voltage wires 52 or an electrical connector that is electrically connected to the low voltage wires 52.

L. Operation of Preferred Embodiment.

In use, the user determines the location where they would like low voltage lighting 70 and installs the low voltage lighting 70 accordingly. The user then plugs in the power plug 50 into a power socket 14, 15 and then secures the housing 20 to the building wall 11 by attaching a fastener member 18 through the aperture 46 within the housing 20 as illustrated in FIG. 8 of the drawings. The user then electrically connects the low voltage wires 52 to the low voltage lighting 70 by extending the low voltage wires 52 through one of the openings 30, 32 and then through (or outside of) the building wall 11. FIG. 8 illustrates the low voltage wires 52 extending through the wallboard of the building wall 11, however, the low voltage wires 52 may be attached to the exterior surface of the building wall 11. The user activates the low voltage power supply 62 by closing the power switch 60 thereby providing low voltage power to the low voltage lighting 70 which is then illuminated. The user also may adjust the voltage level of the low voltage power using the dimmer switch 64.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A wall outlet power supply, comprising:

a housing having a main interior;

a power plug attached to said housing, wherein said power plug is adapted for electrically connecting to a power socket of a wall outlet;

a low voltage power supply positioned within said main interior of said housing and electrically connected to said power plug; and a plurality of low voltage wires extending from housing and electrically connected to said low voltage power supply;

wherein said housing includes at least one door removably attached to said housing to selectively enclose a wiring area wherein said housing includes at least one spacer extending outwardly from a rear wall of said housing; wherein said at least one spacer is positioned so that a distal end of said at least one spacer engages a building wall surrounding a wall outlet and not a wall plate that encloses said wall outlet when said power plug is connected to said power socket of said wall outlet; wherein said housing has a width greater than 2¾ inches and wherein said at least one spacer is near a sidewall of said housing.

2. The wall outlet power supply of claim 1, wherein said at least one spacer is comprised of a first spacer extending outwardly from said rear wall of said housing near a first sidewall of said housing and a second spacer extending outwardly from said rear wall of said housing near a second sidewall of said housing, wherein said second sidewall is opposite of said first sidewall.

3. The wall outlet power supply of claim 1, wherein said at least one spacer is near a lower portion of said housing.

4. The wall outlet power supply of claim 1, wherein said at least one spacer extends outward a distance at least equal to or greater than a thickness of a wall plate for said wall outlet.

5. The wall outlet power supply of claim 1, wherein said at least one spacer extends outwardly a distance from said rear wall sufficient to maintain a parallel relationship between a rear surface of said rear wall and a building wall surrounding said wall outlet when said power plug is fully inserted into said power socket.

6. The wall outlet power supply of claim 1, wherein said wiring area is separated from said main interior by a divider.

7. The wall outlet power supply of claim 1, wherein said housing includes at least one side opening within at least one sidewall connecting said wiring area and an area external of said housing.

8. The wall outlet power supply of claim 7, wherein low voltage wires extend into said wiring area.

9. The wall outlet power supply of claim 1, wherein said housing includes at least one rear opening within a rear wall of said housing connecting said wiring area and an area external of said housing.

10. The wall outlet power supply of claim 1, including an aperture extending through a rear wall of said housing from within said wiring area, wherein said aperture receives a fastener member to secure said housing to a building wall.

11. The wall outlet power supply of claim 1, including an aperture extending through a rear wall of said housing, wherein said aperture receives a fastener member to secure said housing to a building wall.

12. The wall outlet power supply of claim 11, including a fastener spacer surrounding said aperture and extending outwardly from said rear wall to distally space said rear wall from said building wall when said fastener member attaches said housing to said building wall.

13. The wall outlet power supply of claim 1, including a power switch within said main interior of said housing, wherein said power switch is electrically connected to said low voltage power supply.

14. The wall outlet power supply of claim 13, including a dimmer switch within said main interior of said housing, wherein said dimmer switch is electrically connected to said low voltage power supply and/or said power switch.

15. The wall outlet power supply of claim 1, including a low voltage lighting electrically connected to said low voltage wires.

16. A wall outlet power supply, comprising:

a housing having a main interior;

a power plug attached to said housing, wherein said power plug is adapted for electrically connecting to a power socket of a wall outlet;

a low voltage power supply positioned within said main interior of said housing and electrically connected to said power plug; and a plurality of low voltage wires extending from housing and electrically connected to said low voltage power supply;

wherein said housing includes at least one spacer extending outwardly from a rear wall of said housing, wherein said at least one spacer is positioned so that a distal end of said at least one spacer engages a building wall surrounding a wall outlet and not a wall plate that encloses said wall outlet when said power plug is connected to said power socket of said wall outlet wherein said housing has a width greater than 2¾ inches and wherein said at least one spacer is near a sidewall of said housing.

17. A wall outlet power supply, comprising:

a housing having a main interior;

a power plug attached to said housing, wherein said power plug is adapted for electrically connecting to a power socket of a wall outlet;

a low voltage power supply positioned within said main interior of said housing and electrically connected to said power plug;

a plurality of low voltage wires extending from housing and electrically connected to said low voltage power supply; and a dimmer switch within said main interior of said housing, wherein said dimmer switch is electrically connected to said low voltage power supply wherein said housing includes at least one spacer extending outwardly from a rear wall of said housing; wherein said at least one spacer is positioned so that a distal end of said at least one spacer engages a building wall surrounding a wall outlet and not a wall plate that encloses said wall outlet when said power plug is connected to said power socket of said wall outlet; wherein said housing has a width greater than 2¾ inches and wherein said at least one spacer is near a sidewall of said housing.

* * * * *